United States Patent [19]

Iwasaki et al.

[11] Patent Number: 4,842,312

[45] Date of Patent: Jun. 27, 1989

[54] DOOR LOCKING KNOB STRUCTURE

[75] Inventors: Eiji Iwasaki, Shizuoka; Yukio Isomura, Aichi, both of Japan

[73] Assignees: Toyota Jidosha Kabushiki Kaisha; Aisin Seiki Kabushiki Kaisha, both of Japan

[21] Appl. No.: 876,840

[22] Filed: Jun. 20, 1986

[30] Foreign Application Priority Data

Jun. 21, 1985 [JP] Japan ..... 60-094895[U]

[51] Int. Cl.[4] ..... E05C 21/00

[52] U.S. Cl. ..... 292/336.3; 292/347; 292/DIG. 37; 292/DIG. 63

[58] Field of Search ..... 292/347, 150, 207, 106, 292/336.3, DIG. 37, DIG. 63

[56] References Cited

U.S. PATENT DOCUMENTS

| | | | |
|---|---|---|---|
| 1,139,869 | 5/1915 | Howard | 292/DIG. 31 X |
| 2,908,155 | 10/1959 | Schumann | 292/347 X |
| 2,950,614 | 8/1960 | Evans | 292/347 X |
| 3,025,092 | 3/1962 | Weiner | 292/163 |
| 3,117,532 | 1/1964 | Moorhead | 292/150 X |
| 4,606,567 | 8/1986 | Kato et al. | 292/DIG. 38 X |

FOREIGN PATENT DOCUMENTS

| | | |
|---|---|---|
| 127262 | 2/1981 | Japan . |
| 17221 | 7/1985 | Japan . |

*Primary Examiner*—Richard E. Moore

*Attorney, Agent, or Firm*—Finnegan, Henderson, Farabow, Garrett & Dunner

[57] ABSTRACT

A door locking knob structure for a vehicle has a push-button provided on the side of a knob main body which faces the inside of the compartment of the vehicle in such a manner that the push-button is movable together with the knob main body. When pressed, the push-button is withdrawn into the knob main body so as to define a finger receiving recess which allows an occupant of the vehicle to apply his finger thereto and raise the knob main body. Accordingly, when the door is in a locked state, the push-button makes the finger receiving recess disappear, and there is no gap between the push-button and the knob main body. Thus, it is possible to prevent any accidental or undesirable unlocking of the door.

20 Claims, 5 Drawing Sheets

DOOR LOCKING KNOB STRUCTURE

BACKGROUND OF THE INVENTION

1. Field of the Invention

The present invention relates to a door locking knob structure which is mainly used for locking a door of a vehicle to prevent it from being opened.

2. Description of the Relateed Art

One type of conventional door locking knob structure has heretofore been arranged such that a door of a vehicle is selectively locked and unlocked by changing the amount by which a projecting part of a knob main body projects from the door. In this type of door locking knob structure, the projecting part of the knob main body is provided with an enlarged portion at the distal end thereof, or provided with a recess near the distal end portion, thereby allowing the knob main body to be actuated easily. However, the projecting part of the knob main body, which projects from the door, preferably has a smooth structure in which no projection or recess is provided in order to prevent the projecting part from being accidentally moved to unlock the door.

To overcome this problem, an arrangement in which a locking knob is provided on the indoor-side surface of a door has been proposed (e.g., Japanese Utility Model Laid-Open No. 127262/1981). However, in this structure also, the locking knob projects to such an extent that it readily catches the occupant's finger, clothes or the like so as to be accidentally moved to an unlocked position. Therefore, it is not possible to reliably prevent undesirable unlocking of the door.

In order to solve these problems, the applicant of the present invention has already proposed a knob structure in which a recess is defined at the lower end portion of the knob so that an unlocking operation is allowed to be conducted only when the door is unlocked intentionally. (see Japanese Utility Model Application No. 17221/1985). In this knob structure, however, a button which is adapted to define a recess at the lower end portion of the knob is secured to the door, and there is therefore a gap between the button and the locking knob when the knob is in a locking state, which means that it is still impossible to reliably prevent undesirable or accidental unlocking of the door.

SUMMARY OF THE INVENTION

In view of the above-described circumstances, it is a primary object of the present invention to provide a door locking knob structure which eliminates the chance of the locking knob being accidentally moved to unlock the door and which facilitates the operation of unlocking the door.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein the door of this invention comprises a knob main body slidably mounted on a door, and adapted to be connected to locking means for selectively locking or unlocking the door by sliding movement of the knob main body with respect to the door; and a depressable push-button resiliently mounted on the knob main body, the push-button projecting only slightly so as to be substantially flush with the remainder of the knob main body when undepressed and defining when depressed a finger receiving recess on the knob main body; whereby when the push-button is depressed by a finger the knob main body can be moved by this finger which is positioned within the finger receiving recess, and when undepressed the first receiving recess disappears by virtue of the push-button projecting only slightly so as to be substantially flush with the knob main body to prevent any accidental or undesirable unlocking of the door.

By virtue of the above-described arrangement, when the door is in a locked state, the push-button makes the finger receiving recess disappear, and there is no gap between the push-button and the knob main body. It is therefore possible to prevent any accidental or undesirable unlocking of the door. When the occupant presses the push-button in order to unlock the door, a finger receiving recess is readily defined between the knob and the push-button, thereby facilitating the unlocking operation.

The the push-button is arranged such that, when the door is locked, the surface of the push-button slightly projects from the surface of the knob main body to completely eliminate the gap between the push-button and the knob main body.

The accompanying drawings, which are incorporated in and constitute a part of this specification, illustrate one embodiment of the invention and, together with the description, serve to explain the principles of the invention.

DESCRIPTION OF THE PREFERRED EMBODIMENTS

Figure 1:
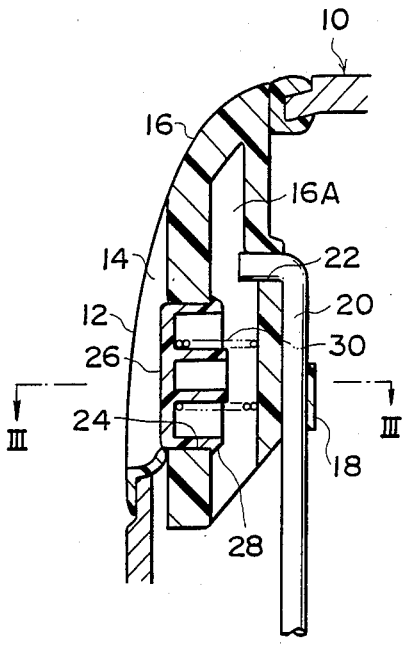
FIG. 1 shows one embodiment of the door locking knob structure constructed according to the present invention, which corresponds to a sectional view taken along the line I—I in FIG. 2.
Figure 2:
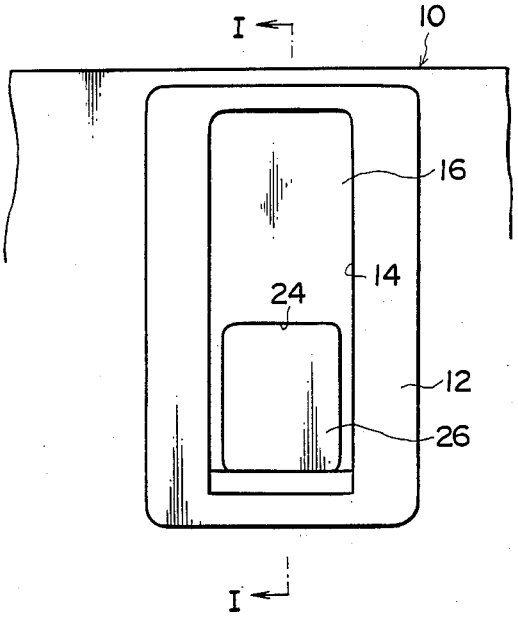
FIG. 2 is a side view of the embodiment shown in FIG. 1 as viewed from the left-hand side thereof.

FIGS. 1 and 2 show in combination one embodiment of the door locking knob structure according to the present invention.

A knob casing 12 is buried in a shoulder portion of a door 10 which faces the inside of the commpartment. The knob casing 12 is provided with a through-hole 14 which extends vertically so as to provide communication between the inside and outside of the door 10.

Figure 5:
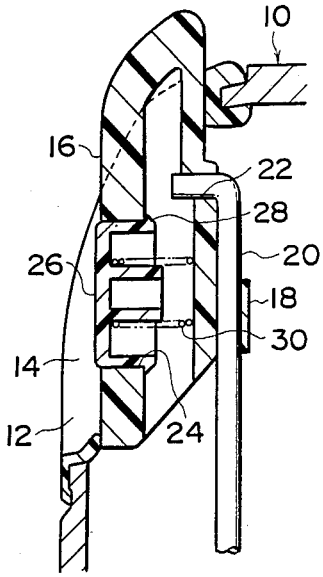
FIG. 5 is a sectional view of the locking knob in the embodiment shown in FIG. 1 in which the knob main body is shown in a raised state.

A knob main body 16 is received in the through-hole 14 in such a manner that the knob main body 16 is movable vertically from a locking position shown in FIG. 1 to an unlocking position shown in FIG. 5. The knob main body 16 has the shape of a rectangular tube which has a hollow portion 16A and whose upper end is closed.

Figure 3:
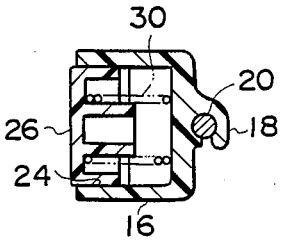
FIG. 3 is a sectional view taken along the line III—III in FIG. 1.

As also shown in FIG. 3, a hook 18 projects from the rear surface of the knob main body 16, that is, the surface thereof which faces the inside of the door 10, and the upper end portion of a lock link 20 is press-fitted into the hook 18. The lock link 20 is bent at right angles at the upper end portion thereof which is above the portion press-fitted into the hook 18, and the bent upper end portion is received in a bore 22 with a circular cross-section provided in the knob main body 16. The lower end portion (not shown) of the lock link 20 is connected to a door latch mechanism (not shown), so that, when the knob main body 16 is in a locking state shown in FIG. 1, the door 10 is prevented from being opened, by the door handles (not shown) whereas, when the knob main body 16 is in an unlocking state shown in FIG. 5, the door 10 is allowed to be opened by the door handles (not shown).

Figure 4:
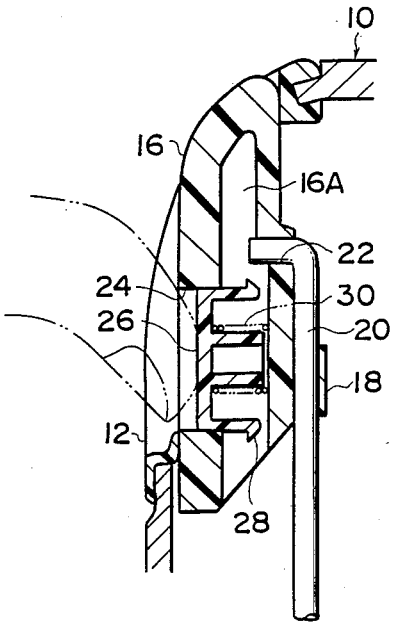
FIG. 4 is a sectional view of the locking knob of the embodiment shown in FIG. 1 in which the push-button is shown depressed.

A bore 24 with a rectangular cross-section is provided in the side of the knob main body 16 which faces the inside of the compartment so that the inside and outside of the knob main body 16 are communicated with each other. A push-button 26 is slidably received in the bore 24. The outside surface of this push-button 26 defines a surface against which an occupant presses his finger as shown in FIG. 4. One end portion of the push-button 26 which is disposed inside the knob main body 16 is provided with retaining pieces 28 which extend outwardly in opposite directions so that the retaining pieces 28 are engageable with the inner end of the rectangular bore 24, that is, the peripheral edge at one end of the bore 24 which faces the hollow portion 16A, thereby limiting the amount by which the push-button 26 projects from the knob main body 16. In addition, a compression coil spring 30 is interposed between the inner wall of the push-button 26 and the inner wall of the knob main body 16 which faces the hollow portion 16A, so that the push-button 26 is biased in a direction outwardly of the bore 24, that is, in a direction in which it projects into the compartment of the vehicle.

As shown in FIG. 1, the position of the retaining pieces 28 is determined so that, when the knob main body 16 is in a locking state, the surface of the push-button 26 slightly projects from the surface of the knob main body 16. By so doing, the surface of the knob main body 16, when placed in a locking state, is made smooth so that the knob main body 16 is no accidentally actuated to an unlocked position.

The following is a description of the operation of this embodiment.

When the knob main body 16 is in a locking state shown in FIG. 1, it is pushed into the door 10, and the lock link 20 causes the latch mechanism (not shown) to be brought into a locking state, whereby the door 10 is locked from being opened.

In this state, the surface of the knob main body 16 and the surface of the push-button 26 are substantially flush with each other, with the surface of the push-button 26 slightly projecting from the surface of the knob main body 16. There is therefore no fear of a metal bar or the like being accidentally caught by the push-button 26 to raise the knob main body 16 undesirably.

To unlock the door 10, the occupant presses the push-button 26 into the knob main body 16 as shown in FIG. 4, applies his finger to the inner peripheral surface of the rectangular bore 24, and pushes the knob main body 16 upwardly. In consequence, the knob main body 16 is raised as shown in FIG. 5, and the lock link 20 causes the latch mechanism (not shown) to be brought into an unlocking state.

Figure 6:
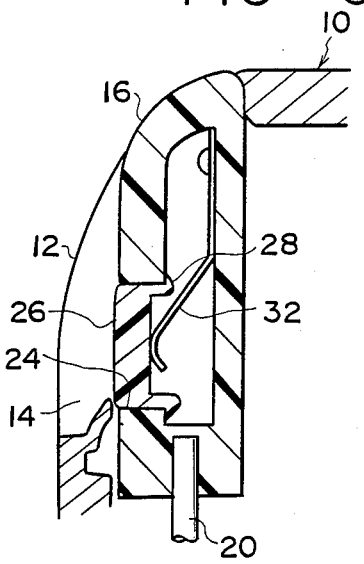
FIG. 6 is a sectional view of a second embodiment of the present invention.

FIG. 6 shows a second embodiment of the door locking knob structure according to the present invention. This embodiment differs from the first embodiment in that a leaf spring 32 is employed to bias the push-button 26 in a direction in which it projects from the knob main body 16. Further, the lock link 20 in this embodiment is rigidly secured to the lower end of the knob main body 16.

The arrangement of the other portion of this embodiment is similar to that in the first embodiment, and it is therefore possible to obtain advantages similar to those offered by the first embodiment.

Although in the above-described embodiments the push-button 26 is formed as a member which is separate from the knob main body 16 and is slidably received in the rectangular bore 24, this is not necessarily limitative. For example, a part of the push-button 26 may be integrally connected to the knob main body 16 in an integral hinge manner such that the push-button 26 is able to pivot relative to the knob main body 16 so as to allow the occupant to apply his finger to the inner peripheral portion of the rectangular bore 24 when the push-button 26 is pressed.

Although each of the above-described embodiments is arranged such that, when the door 10 is locked, the knob main body 16 is completely withdrawn into the door 10, that is, the upper end of the knob main body 16 does not project from the door 10, such arrangement is not necessarily limitative, and said end may project from the door 10 when in a locked state.

Figure 7:
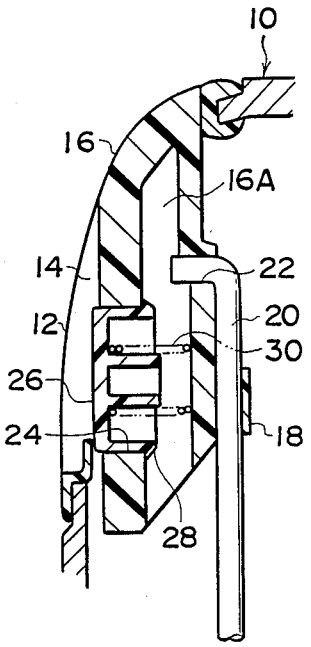
FIG. 7 and 8 are sectional views respectively showing modifications of the present invention.
Figure 8:
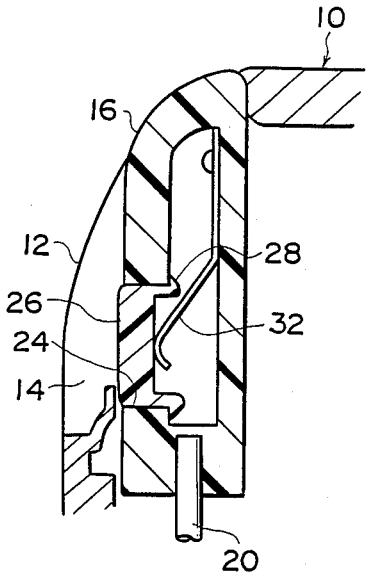

In addition, as shown in FIGS. 7 and 8 the arrangement may be such that, when the knob main body 16 is in a locking state, the knob casing 12 slightly laps over the lower end of the push-button 26 without fail. By so doing, it is possible to prevent the occupant's finger or other object from being accidentally caught by the push-button 26.

As has been described above, the door locking knob structure according to the present invention has a knob main body adapted to allow a door to be selectively locked and unlocked by changing the amount by which the knob main body projects from the door, and a push-button provided on the side of the knob main body which faces the inside of the compartment and adapted to be withdrawn into the knob main body when it is pressed so as to define a recess which allows an occupant to apply his finger thereto. It is therefore possible to prevent any accidental or undesirable movement of the knob main body when the door is in a locked state, and to allow the knob main body to be readily actuated when the door is unlocked.

What is claimed is:

1. A locking knob for the interior side of a vehicle door, comprising:

(a) a knob main body slidably mounted on said door, and adapted to be connected to locking means for selectively locking or unlocking said door by sliding movement of said knob main body with respect to said door; and (b) a depressable push-button resiliently mounted on the knob main body, said push-button projecting only slightly so as to be substantially flush with the remainder of the knob main body when undepressed and defining when depressed a finger receiving recess on the knob main body;

(c) whereby when said push-button is depressed by a finger the knob main body can be moved by this finger which is positioned within said finger receiving recess, and when undepressed said finger receiving recess disappears by virtue of said push-button being substantially flush with the knob main body to prevent any accidental or undesirable unlocking of said door.

2. A locking knob according to claim 1, wherein said knob main body has an opening and said push-button is resiliently mounted in said opening so as to project when undepressed slightly out from the knob main body.

3. A locking knob according to claim 2, wherein said push-button is resiliently and slidably mounted in said opening of said knob main body.

4. A locking knob according to claim 1, further comprising a spring mounted on said push-button, said push-button being urged by said spring when undepressed to be substantially flush with said knob main body.

5. A locking knob according to claim 4, wherein the knob main body has a periphery and a lower end and further comprising a knob casing enclosing the periphery of said knob main body, and covering the lower end portion of said push-button.

6. A locking knob according to claim 2, wherein said push-button has a retaining piece provided thereon and said opening has an inner edge, said retaining piece being engageable with the inner edge of said opening, to limit thereby the projecting of said push-button out from said knob main body.

7. A locking knob according to claim 4, wherein said spring is a compression coil spring.

8. A locking knob according to claim 4, wherein said spring is a leaf spring.

9. A locking knob for a door for locking the interior compartment of a vehicle, comprising:

(a) a knob main body slidably mounted within a bore provided in a shoulder portion of the door which faces the interior compartment, and adapted to be connected to locking means for selectively locking or unlocking said door by sliding movement of said knob main body with respect to said door, and said knob main body has an opening which faces the interior compartment; and (b) a depressable push-button resiliently mounted within said opening of said knob main body, said push-button being adapted to extend into said opening when it is depressed so as to define a finger receiving recess in which an occupant of the vehicle may apply his finger;

(c) whereby when said push-button is depressed by the occupant's finger said knob main body can be moved by this finger which is positioned within said finger receiving recess, and when undepressed said finger receiving recess disappears to prevent any accidental or undesirable unlocking of said door.

10. A locking knob according to claim 9, wherein said push-button is resiliently and slidably mounted in said opening of said knob main body so that when undepressed it slightly projects out from the surface of said knob main body.

11. A locking knob according to claim 9, further comprising a spring mounted on said push-button in said knob main body.

12. A locking knob according to claim 11, wherein said push-button is biased by said spring such that said push-button projects from said knob main body.

13. A locking knob according to claim 12, wherein the knob main body has a periphery and a lower end and further comprising a knob casing enclosing the periphery of said knob main body, and covering the lower end portion of said push-button.

14. A locking knob according to claim 13, wherein said push-button has a retaining piece provided thereon and said opening has an inner edge, said retaining piece being engageable with the inner edge of said opening, to limit thereby the of said push-button projecting out from said knob main body.

15. A locking knob according to claim 11, wherein said spring is a compression coil spring.

16. A locking knob according to claim 11, wherein said spring is a leaf spring.

17. A locking knob for a vehicle door for locking the interior compartment of the vehicle and arranged so as to move between the inside of the door to a position that projects outwardly from the door, which comprises:

(a) a knob casing disposed in a shoulder portion of said door facing the interior of the compartment;

(b) a through-hole formed in said knob casing so as to provide communication therethrough;

(c) a knob main body disposed within said through-hole and adapted to be connected to locking means to allow said door to be selectively locked and unlocked by movement of said knob main body from inside the door to said position that projects outwardly from said door;

(d) an opening having a substantially rectangular cross-section provided in said knob main body and facing the interior of the compartment;

(e) a depressable push-button having a substantially rectangular cross-section and mounted within said substantially rectangular opening and adapted to extend into said knob main body when it is depressed so as to define a finger receiving recess in which an occupant of the vehicle may apply his finger; and (f) a spring for urging said push-button in a direction opposite to the direction in which it extends when depressed into said knob main body, whereby when said push-button is depressed by the occupant's finger said knob main body can be moved by this finger which is positioned within said finger receiving recess, and when said push-button is undepressed the finger receiving recess disappears to prevent any accidental or undesirable unlocking of said door.

18. A locking knob according to claim 17, wherein said push-button is mounted to slightly project, when undepressed, from the surface of said knob main body so as to define a step.

19. A door locking knob structure according to claim 18, wherein said push-button is slidably disposed in said knob main body.

20. A door locking knob structure according to claim 19, wherein the lower end portion of said push-button is slightly covered by said knob casing.

* * * * *